US005628478A

United States Patent [19]

McConnel et al.

[11] Patent Number: 5,628,478

[45] Date of Patent: May 13, 1997

[54] CAB SIGNAL PICKUP SYSTEM WITH MOTOR NOISE REDUCTION

[75] Inventors: Lee A. McConnel, Parkville; John H. Johnson, Blue Springs, both of Mo.

[73] Assignee: Harmon Industries, Inc., Blue Springs, Mo.

[21] Appl. No.: 381,438

[22] Filed: Jan. 31, 1995

[51] Int. Cl.[6] ..... B61L 15/00

[52] U.S. Cl. ..... 246/194; 246/63 R

[58] Field of Search ..... 246/194, 193, 246/63 R, 63 A, 63 C, 1, 8, 34 R, 34 B, 167 R, 196, 197

[56] References Cited

U.S. PATENT DOCUMENTS

| | | | |
|---|---|---|---|
| 2,071,056 | 2/1937 | Allison | 246/194 |
| 2,662,934 | 12/1953 | Allison | 246/194 |
| 3,555,270 | 1/1971 | Persson | 246/194 |
| 4,081,160 | 3/1978 | Devy et al. | 246/63 C |
| 4,508,298 | 4/1985 | Salmon | 246/63 R |
| 4,720,067 | 1/1988 | Jaeger | 246/63 R |
| 5,234,184 | 8/1993 | Chew | 246/194 |

FOREIGN PATENT DOCUMENTS

| | | | |
|---|---|---|---|
| 538726 | 4/1954 | Italy | 246/194 |
| 1065399 | 4/1967 | United Kingdom | 246/194 |

*Primary Examiner*—Mark T. Le
*Attorney, Agent, or Firm*—Chase & Yakimo

[57] ABSTRACT

Inductive pickups for sensing coded cab current information employ short ferrite cores and exhibit a pronounced roll-off characteristic to provide a detection system that may be used with locomotives powered by alternating current traction motors. Desired response is enhanced by connecting the inductors in phase in a tuned circuit and by employing a cancelling coil in phase opposition that receives interfering motor noise but is insensitive to the coded information.

11 Claims, 5 Drawing Sheets

FREQUENCY RESPONSE IN 60Hz & 100Hz APPLICATION

CAB SIGNAL PICKUP SYSTEM WITH MOTOR NOISE REDUCTION

BACKGROUND OF THE INVENTION

This invention relates to the detection of coded or modulated electrical currents that are transmitted through the rails of a railroad track for control purposes and, more particularly, to improved inductive pickup coils and associated circuitry for sensing the control information in a high noise level environment.

Railroad signalling has traditionally been based upon the concept of protecting zones of track, called "blocks," by means of some form of signal system that conveys information to the locomotive engineer about the status of the track ahead. Typically, wayside signal lights are located along the track and are controlled by electrical logic circuits responsive to the presence of trains and the status of blocks that are relevant to a given wayside signal. Each wayside signal is thus caused to display a pattern of lights, called the "aspect" of the signal, which is visible to the engineer in the locomotive and indicates the status at that location.

A more advanced signalling system in widespread use is referred to as cab signalling and may be used with or without wayside signal lights. In cab signalling the same logic that determines block status for display on the wayside signals is also used to generate one of several forms of encoded electrical current in the rails, block status being represented by the selection of the code rate used. Inductive pickup coils are mounted on the locomotive ahead of the lead wheels and just above the rails for the purpose of sensing the magnetic fields around the rails produced by the encoded current. In modern systems a computer on board the locomotive decodes the detected information to determine the status and display the proper aspect in the engine cab by a pattern of lights in the same manner as a wayside signal. One advantage, of course, is that the information is made available to the train crew on a continuous basis and updated immediately when changes in status occur, rather than restricting the communication of status information to periodic intervals along the track at which the engineer is required to observe and read the next wayside signal.

The pickup coils typically used in cab signal systems are iron core inductors employed in pairs, one being mounted above each rail. The carrier frequency of the coded cab current for freight operations is typically in the range of from 40 Hz to 100 Hz but may be as high as 250 Hz. Examples of modulation rates and corresponding aspects are, for example, discussed in U.S. Pat. No. 5,340,062, issued Aug. 23, 1994. The iron core of the pickup coil is relatively long, of the order of 30 inches, and extends across the underlying rail, the long core length being utilized both for high sensitivity and to assure that the coil will at all times overlie the rail irrespective of the position of the locomotive, e.g., lateral displacement of the locomotive body relative to the rails as the train traverses a curve.

Inductors of the above described type operate quite satisfactorily in diesel locomotives in which the engines drive direct current generators that, in turn, supply current to DC traction motors. However, modern diesel locomotives employ solid state switching that has made the use of alternating current traction motors possible and eliminated the high maintenance requirements associated with the use of direct current motors. The alternating current frequency can vary from approximately 20 Hz to 300 Hz in accordance with rotor speed as dictated by the speed requirements of the train. This results in the generation of an alternating current magnetic field by the AC traction motors that did not exist in the direct current powered locomotives. Being in the same frequency range as the cab signal carrier, the AC traction motors, in effect, are a source of high level noise which is received by the long core pickup coils along with the coded cab current and renders them unusable as a reliable control information sensor.

SUMMARY OF THE INVENTION

It is, therefore, the primary object of the present invention to provide an inductive pickup system for use in cab signalling which has a sufficiently high signal-to-noise ratio that it may be utilized in locomotives powered by AC traction motors.

Another important object of the invention is to provide a system as aforesaid which utilizes a pickup coil over each rail having a core of sufficiently short length to cause the sensitivity of the coil to have a pronounced roll-off characteristic that decreases the relative response of the coil to noise generated by the AC traction motors which are more distant from the coil than the rail.

Another important object is to provide such a system in which the pickup coils, though located in an environment in which the noise from the AC motors is present, are mounted in close proximity to the underlying rails to increase the signal strength of the sensed control information relative to the noise.

Still another important object of this invention is to provide a pickup coil for such systems having a core of relatively short length as aforesaid but which is composed of a high permeability material to increase the sensitivity of the coil.

Yet another important object is to provide such a system in which pickup coils are mounted in close proximity to the rails and remain in the same operative positions irrespective of lateral displacement of the locomotive with respect to the rails as the train moves along the track.

A further object of the invention is to include the pickup coils in a resonant circuit tuned to a narrow frequency range that includes the carrier frequency of the control information therein.

Furthermore, it is an important object of the present invention to provide an inductive pickup system for cab signalling which, in addition to pickup coils over the rails, employs a cancelling coil responsive to the AC motor noise but positioned so as to be substantially insensitive to the control information flowing in the rails, and which has a circuit interconnecting the pickup coils and the cancelling coil with the cancelling coil out of phase therewith to thereby enhance the signal-to-noise ratio.

Another important object is to provide such a cancelling coil having a core of sufficiently short length to render the coil less responsive to nonuniformity in the magnetic field comprising the noise produced by the AC motors.

Other objects will become apparent as the detailed description proceeds.

DETAILED DESCRIPTION

Figure 1:
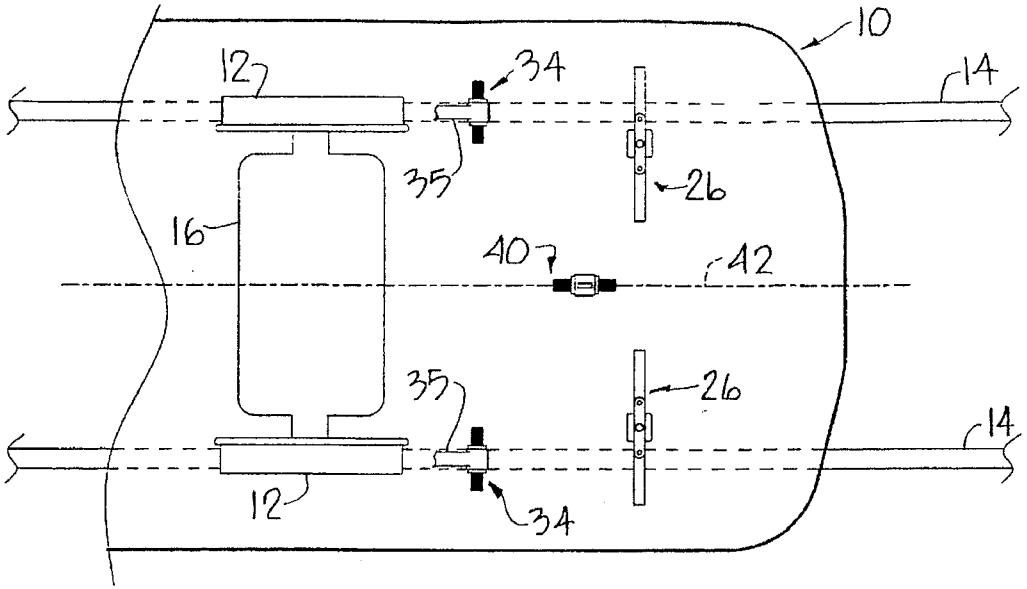
FIG. 1 is a fragmentary, diagrammatic plan view of the forward portion of a locomotive showing the lead wheels and traction motor, the pickup and cancelling coils of the present invention, and the pickup coils of the prior art for comparison purposes.
Figure 2:
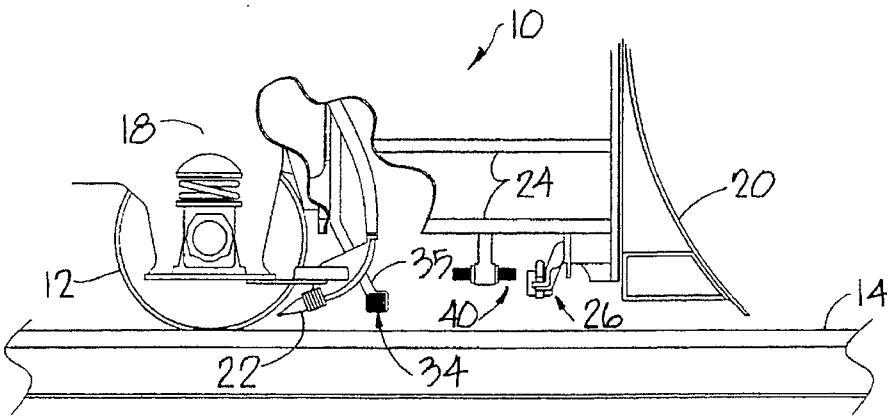
FIG. 2 is a partial, diagrammatic side view of the portion of the locomotive shown in FIG. 1, parts being broken away for clarity.

Referring initially to FIGS. 1 and 2, the front end of a locomotive 10 is diagrammatically illustrated and has a pair of lead wheels 12 in rolling contact with respective underlying rails 14. An alternating current traction motor 16 is located between the wheels 12 with opposite ends of its output shaft coupled with the wheels in the usual manner. The drive assembly comprising the motor 16 and wheels 12 is mounted on a truck 18 in the conventional manner, a portion of the truck 18 being shown in FIG. 2. Other standard components that may be seen include a plow 20, the nozzle 22 of a sander, and steps 24 behind the plow 20. Except for the addition of the system of the present invention to be discussed, the locomotive fragmentarily portrayed in FIGS. 1 and 2 is in all respects a conventional diesel locomotive of present day design employing AC traction motors, including the motor 16, to drive the lead wheels 12 and additional pairs of wheels therebehind which are not shown.

Figure 3:
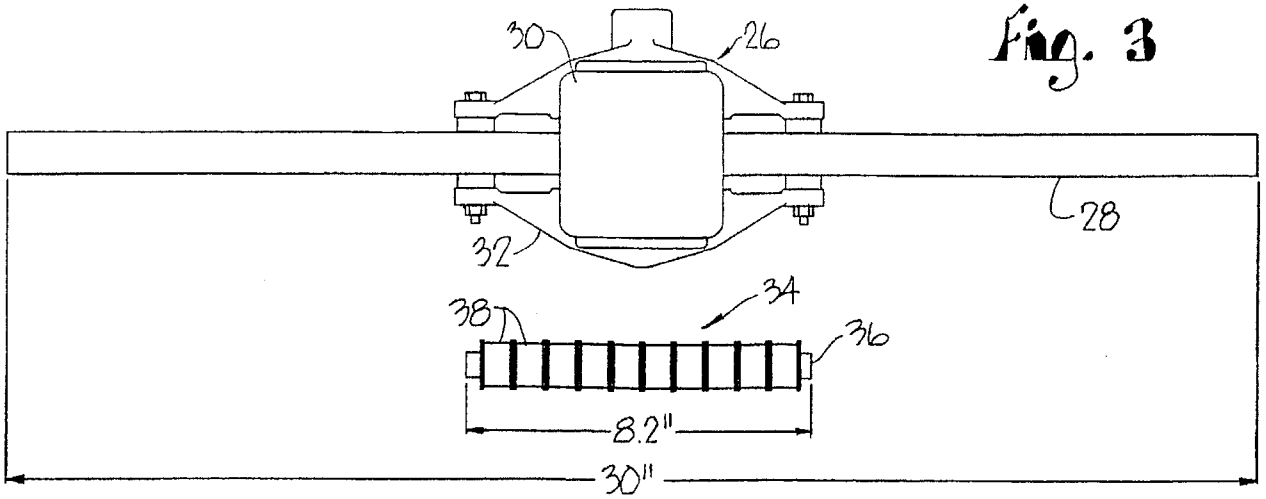
FIG. 3 is a front view of the pickup coil of the present invention and the prior art pickup coil.
Figure 4:
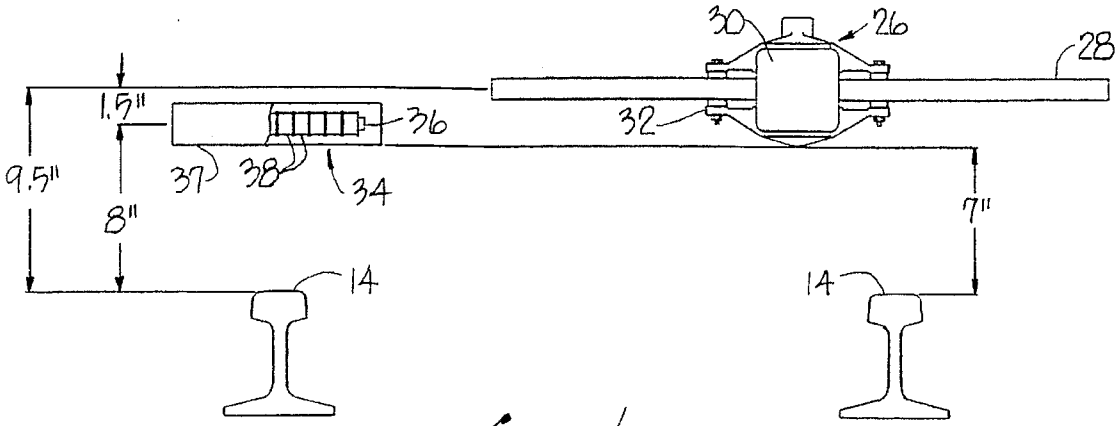
FIG. 4 is a front view of the coils of FIG. 3 showing each in its operative position above an underlying rail.

A pair of pickup coils 26, of a prior type employed on locomotives powered with direct current traction motors, are illustrated FIGS. 1 and 2 in representative positions over corresponding rails 14 and are shown in detail in FIGS. 3 and 4. The prior art coils 26 form a part of a cab signal system and are used to sense the magnetic fields around the rails 14 produced by the coded cab current flowing in the rails, a circuit for the current flow being completed by a short across the rails resulting from the presence of a train which effectively interconnects the two rails 14 by creating a current path through the metallic wheels and axle components. The pickup coils 26 are typically mounted beneath the frame of the locomotive 10 forward of the lead truck 18, the relative position of one of the coils 26 relative to the associated rail 14 being evident from a comparison of FIGS. 1 and 4.

The pickup coil 26 of the prior art has a long iron core 28 typically about 30 inches in length (FIG. 3). An encapsulated center portion 30, midway along the length of the core 28, contains the windings of the coil about the core 28. The encapsulated windings 30 and core 28 are secured mechanically by a clamp 32 attached to the frame of the locomotive. As illustrated in FIG. 4, the longitudinal axis of the core 28 (axis of coil 26) is about 9.5 inches above the top of the underlying rail 14. As locomotive 10 undergoes lateral displacement with respect to rails 14 along curves in the track, the long reach of the core 28 assures that some portion of the core will at all times be directly above the rail 14. Although the long core length provides a sensitive pickup and assures that the coil will at all times overlie the rail, it is unsatisfactory as a pickup in locomotives powered with AC traction motors as the long core is also highly responsive to the AC magnetic fields produced by the motors. As previously discussed, the AC motors are, therefore, a source of high level noise in the same frequency range as the carrier frequencies typically employed in the transmission of the coded cab current through the rails.

A pair of pickup coils 34 of the present invention are shown in FIGS. 1 and 2 above corresponding rails 14, each of which is attached to the end of a mounting arm 35 extending from the truck 18. Referring to FIGS. 3 and 4, each of the coils 34 includes a core 36 of relatively short length, the specific coil 34 shown in detail in FIG. 3 having a core length of 8.2 inches. The core 36 is a cylindrical ferrite rod on which ten bobbins 38 are disposed end to end, each bobbin containing, for example, 800 turns of No. 28 wire. The core and bobbin assembly may be encapsulated in a sleeve 37 as illustrated in FIG. 4, a portion of the sleeve 37 being broken away to reveal the core 36 and bobbins 38 therein.

As shown in FIG. 4, the longitudinal axis of the core 36 (axis of coil 34) is eight inches above the underlying rail 14 and extends at right angles to the vertical plane of the rail. Therefore, as compared with the prior art coil 26, the axis of each of the pickup coils 34 is significantly closer to the top of the underlying rail 14. This places each pickup coil 34 in a stronger signal field while providing the same clearance (about seven inches) due to its smaller geometry. Also, being mounted on the truck 18, each coil 34 remains in the operative position shown in FIG. 4 directly over the corresponding rail 14 in close proximity thereto irrespective of lateral displacement of the locomotive body.

The pickup system of the present invention also employs a cancelling coil 40 similar in construction to the pickup coils 34 but mounted on the locomotive frame ahead of the pickup coils 34 and midway between the rails 14. The cancelling coil 40 also has a high permeability core comprising a straight ferrite rod having a longitudinal axis 42 illustrated in FIG. 1 extending parallel to rails 14. Accordingly, the axis of cancelling coil 40 forms a right angle with the axes of the pickup coils 34, it being appreciated that the parallel relationship of axis 42 and rails 14 prevents the cancelling coil 40 from sensing the magnetic fields around the rails 14 (produced by the cab current) to any significant degree. The cancelling coil 40 is, however, in the environment in which noise from the AC traction motors is present, e.g., the magnetic fields around traction motor 16.

Figure 5:
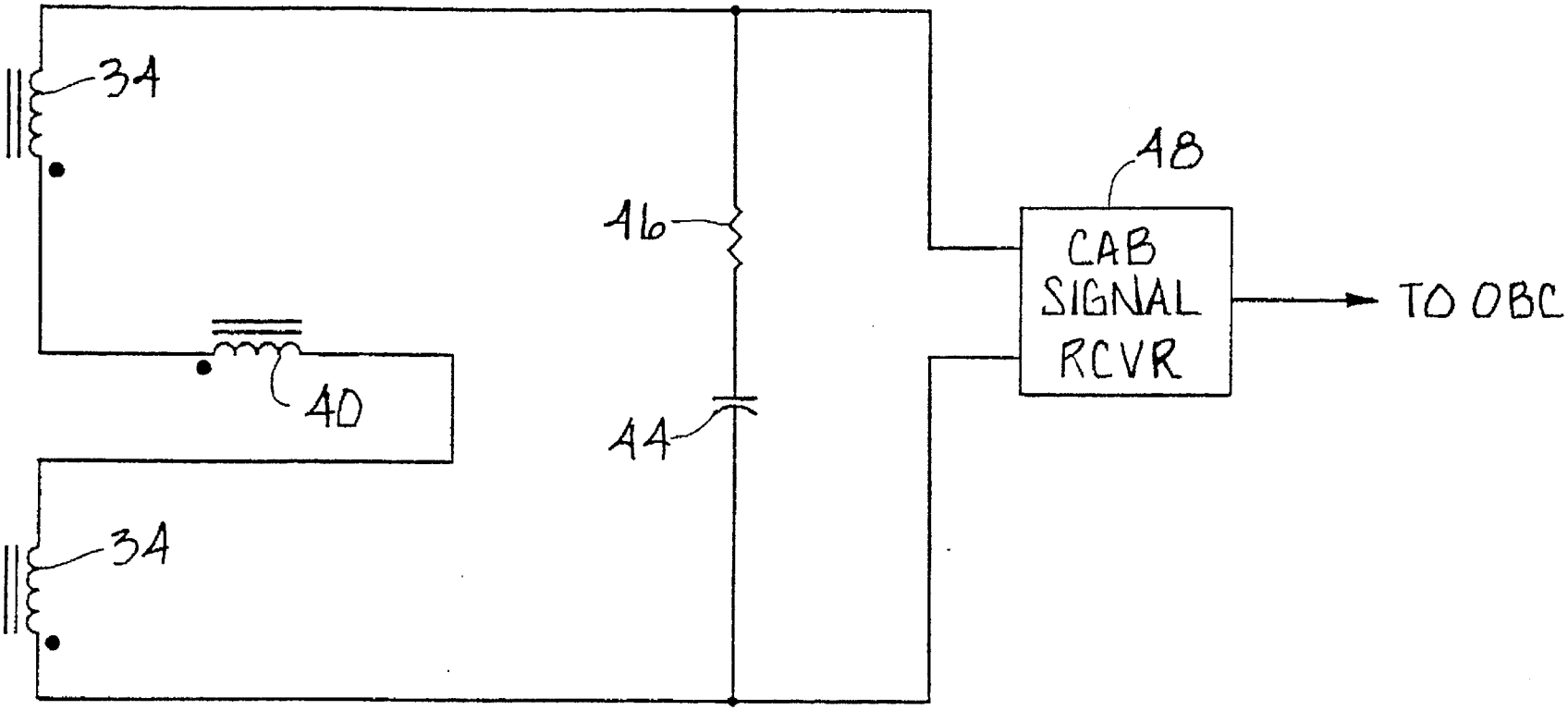
FIG. 5 is an electrical schematic diagram of the pickup and cancelling coils and associated circuitry.

Circuitry associated with the pickup coils 34 and the cancelling coil 40 is shown in FIG. 5 where it may be seen that the three coils are connected in series with the cancelling coil 40 out of phase with the two in-phase pickup coils 34. A parallel resonant circuit is formed by the three coils and a series-connected capacitor 44 and resistor 46. The resonant circuit provides an input to a cab signal receiver 48 on board the locomotive. As is conventional, the receiver 48 decodes the coded cab current information and feeds such information to an on board computer (OBC) which operates the aspect display (not shown) and in advanced systems executes automatic control functions as appropriate. The resonant frequency of the input circuit of FIG. 5 is selected to maximize the response of the circuit over a narrow frequency range that includes the carrier frequency or frequencies of the cab current information.

Figure 6:
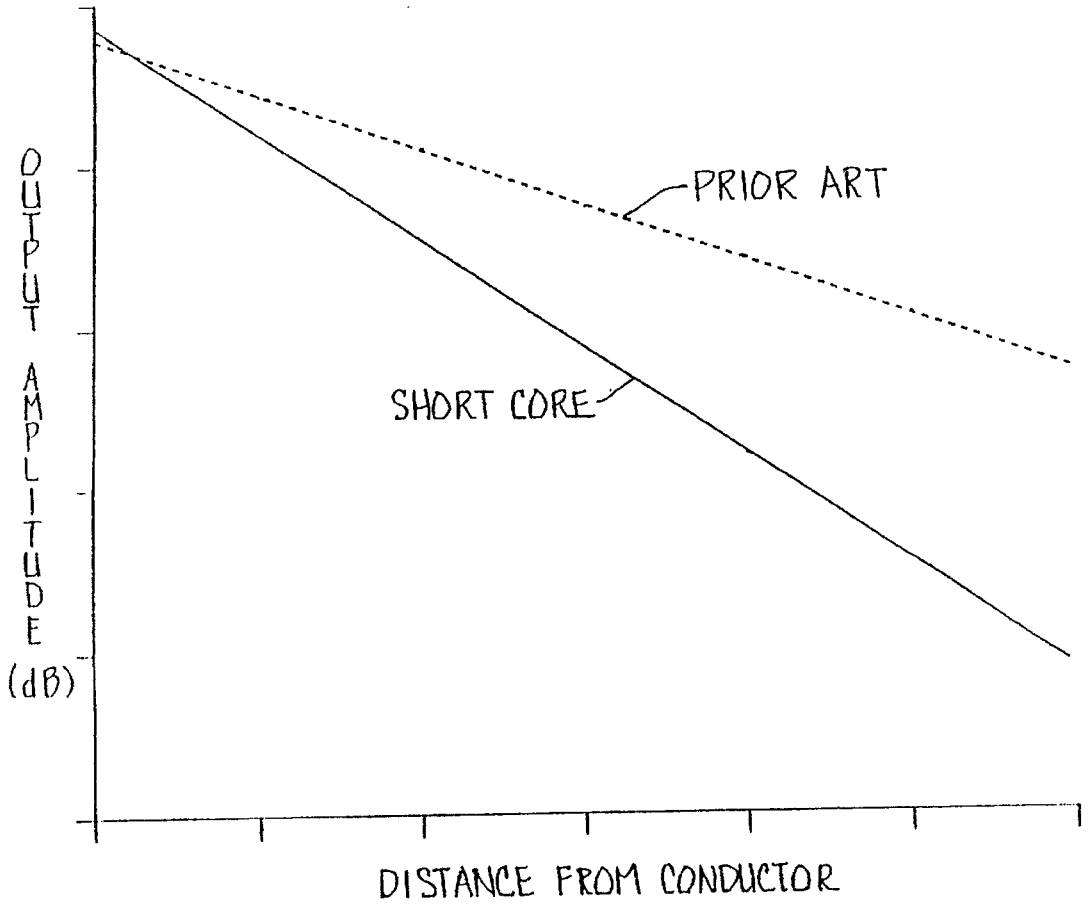
FIG. 6 is a graph showing the pronounced roll-off characteristic of the pickup coil of the present invention.

The graph of FIG. 6 illustrates the pronounced roll-off characteristic of the pickup coils 34 of the present invention (solid line) as compared with the characteristic of the long core coil 26 of the prior art (broken line). The increased slope of the short core graph line represents a drop in amplitude of approximately 3.0 to 3.5 dB for each two-inch increase in distance of the pickup coil 34 from a conductor in which about one ampere rms of 100 Hz current is flowing. The prior art long core coil exhibits a flatter response and decreases about 1.8 dB with each two inch increment. This pronounced roll-off characteristic of the present invention provides an increased signal-to-noise ratio as the pickup coils 34 are in close proximity to the rails but at greater distances from the noise source comprising the AC traction motors, the closest of which is the lead motor 16 seen in FIG. 1.

Although the short core coils 34 have reduced sensitivity as compared to larger coils and, in particular, those with long cores as represented by the prior art coil construction 26, sensitivity is increased in the present invention through the use of the high permeability ferrite material in the core and the number of turns of wire around the core from end to end. For example, for sensing coded currents having a 60 to 100 Hz carrier, a preferred pickup coil would have an inductance of about 5.3 Henrys provided by 8,000 turns (800 per bobbin) of No. 28 wire on a ferrite rod core 8.2 inches in length and 0.6 inch in diameter. The cancelling coil 40 may have lesser inductance (approximately 4.3 Henrys), such as 6,500 turns on the same core size.

Figure 7:
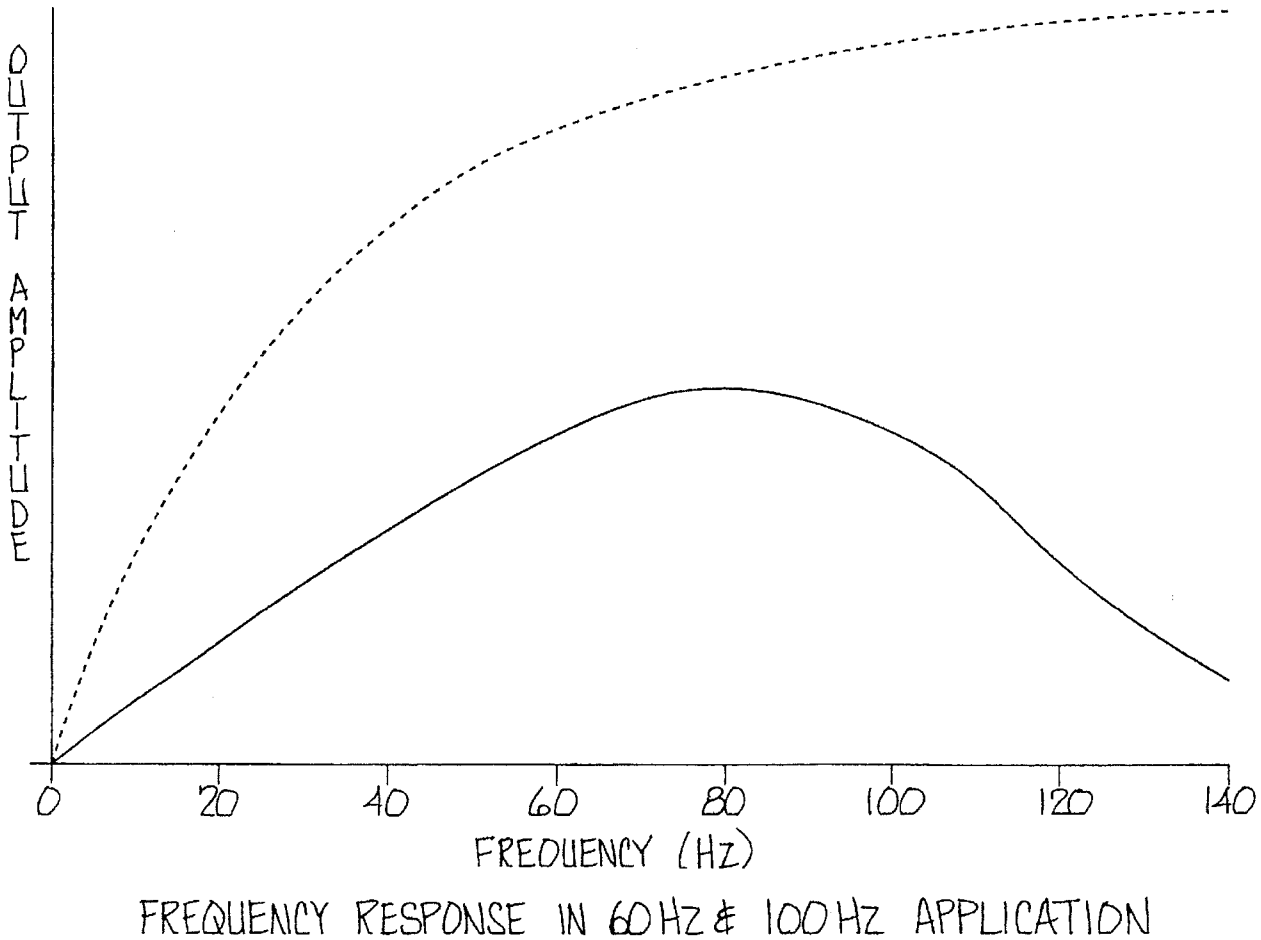
FIG. 7 is a graph in which the solid line shows the frequency response of the circuit of FIG. 5 in applications in which the cab signal carrier is 60 Hz or 100 Hz.

Response to the desired information is also enhanced through the use of the tuned input circuit of FIG. 5 as shown in the graph of FIG. 7 where the solid line represents the frequency response of the circuit for an application using 60 Hz and 100 Hz carrier frequencies, the pickup coils 34 being effectively tuned for approximately equal gain at both frequencies. Representative values are 0.3 microfarad for capacitor 44, and 1,200 ohms for resistor 46. The broken line in FIG. 7 represents the frequency response of the two long core coils 26 connected in phase.

It should also be appreciated that the short core length of the cancelling coil 40 improves its performance in reducing unwanted noise. Its compact size facilitates placement of coil 40 (as in FIGS. 1 and 2) where the magnetic field comprising the noise is uniform so that consistent cancellation is obtained.

Having thus described the invention, what is claimed as new and desired to be secured by Letters Patent is as follows:

1. In a cab signal system having a receiver on board a locomotive and in which control information transmitted through the rails of a railroad track to the locomotive utilizes a carrier having a frequency in a range from 40 Hz or less to approximately 250 Hz, wherein the locomotive employs an alternating current drive motor connected to a pair of rail-engaging wheels and the drive motor emits high level noise in said frequency range, the improvement comprising:

a pair of pickup coils for sensing magnetic fields around the rails produced by said control information, each of said coils having a core of sufficiently short length to cause the sensitivity of the coil to have a pronounced roll-off characteristic with increasing distance from a current-carrying conductor, means for mounting said pickup coils on said locomotive in an environment in which said noise is present but in operative positions closely spaced from corresponding underlying rails, whereby said roll-off characteristic and the proximity of the coils to the rails increases the signal strength of the sensed information relative to said noise, a cancelling coil responsive to said noise, means for mounting said cancelling coil on said locomotive in said environment and in a position intermediate the respective vertical planes of the rails rendering the cancelling coil substantially insensitive to the control information flowing in the rails, and input circuit means for said receiver interconnecting said pickup coils and said cancelling coil with said pickup coils in phase and said cancelling coil out of phase therewith, whereby to enhance the signal-to-noise ratio and deliver the sensed information to the receiver with reduced interference from the drive motor.

2. The improvement as claimed in claim 1, wherein the core of each pickup coil is generally orthogonal to the vertical plane of the underlying rail, and said length is of the order of the vertical spacing between the pickup coil and underlying rail.

3. The improvement as claimed in claim 1, wherein said pickup coil sensitivity decreases at least about 3 dB for each increase in said distance of two inches with about one ampere rms current flowing in said conductor, whereby to provide said pronounced roll-off characteristic.

4. The improvement as claimed in claim 1, wherein the core of each pickup coil is composed of a high permeability material to increase the sensitivity thereof.

5. The improvement as claimed in claim 4, wherein said material is a ferrite.

6. The improvement as claimed in claim 1, wherein said means for mounting said pickup coils includes means movable with said rail-engaging wheels through curves in a railroad track defined by said rails for maintaining the pickup coils in their operative positions closely spaced from corresponding rails.

7. The improvement as claimed in claim 1, wherein said circuit means includes capacitor means connected with said coils for tuning the circuit means to preselected frequencies in said range, whereby to increase response and, therefore, the signal strength of sensed information at said preselected frequencies.

8. The improvement as claimed in claim 1, wherein said cancelling coil has a core of sufficiently short length to render the cancelling coil less responsive to nonuniformity in a magnetic field comprising said noise.

9. In a cab signal system having a receiver on board a locomotive and in which control information transmitted through the rails of a railroad track to the locomotive utilizes a carrier having a frequency in a range from 40 Hz or less to approximately 250 Hz, wherein the locomotive employs an alternating current drive motor connected to a pair of rail-engaging wheels and the drive motor emits high level noise in said frequency range, the improvement comprising:

a pair of pickup coils for sensing said control information, means for mounting said pickup coils on said locomotive in an environment in which said noise is present but in operative positions closely spaced from corresponding rails, a cancelling coil responsive to said noise, means for mounting said cancelling coil on said locomotive in said environment and in a position intermediate the respective vertical planes of the rails rendering the cancelling coil substantially insensitive to the control information flowing in the rails, and input circuit means for said receiver interconnecting said pickup coils and said cancelling coil with said pickup coils in phase and said cancelling coil out of phase therewith, whereby to enhance the signal-to-noise ratio and deliver the sensed information to the receiver with reduced interference from the drive motor.

10. The improvement as claimed in claim 9, wherein said cancelling coil has a core of sufficiently short length to render the cancelling coil less responsive to nonuniformity in a magnetic field comprising said noise.

11. The improvement as claimed in claim 9, wherein each of said pickup coils has an axis disposed generally orthogonal to the vertical plane of the corresponding rail, and said cancelling coil has an axis extending substantially parallel to said rails.

* * * * *